United States Patent [19]

Valker

[11] 3,988,730

[45] Oct. 26, 1976

[54] MULTIPLE PARAMETER MONITORING AND READOUT SYSTEM WITH SAMPLING OF PARAMETERS OF HIGHER PRIORITY THAN THE HIGHEST PARAMETER WHICH IS OUT OF TOLERANCE

[75] Inventor: Henry W. Valker, Wood Dale, Ill.

[73] Assignee: Motorola, Inc., Schaumburg, Ill.

[22] Filed: Dec. 31, 1974

[21] Appl. No.: 537,746

[52] U.S. Cl. ..... 340/412; 340/414; 340/52 F; 307/223 R; 328/43

[51] Int. Cl.[2] ..... G08B 19/00

[58] Field of Search ..... 340/412, 413, 414, 52 R, 340/52 F; 328/43, 48, 71, 75; 307/221 R, 223 R

[56] References Cited

UNITED STATES PATENTS

| | | | |
|---|---|---|---|
| 3,581,066 | 5/1971 | Maure | 328/48 |
| 3,582,949 | 6/1971 | Forst | 340/414 |

*Primary Examiner*—John W. Caldwell
*Assistant Examiner*—William M. Wannisky
*Attorney, Agent, or Firm*—James W. Gillman; Donald J. Lisa

[57] ABSTRACT

Apparatus for monitoring and indicating parameter conditions within a system. Signals are generated by sensors which monitor parameter state. The signals are sensed via a multiplexing scheme, each signal being compared to an individually programmed reference. Should a parameter signal exceed the reference, a corresponding indicator is activated. Each parameter is prioritized such that a parameter signal which exceeds its reference will cause the multiplex network to sequentially sense only that parameter and all other parameters of a higher priority. Further refinements allow the readout of the value of a parameter signal if the parameter exceeds its reference or if such readout is manually selected.

17 Claims, 3 Drawing Figures

MULTIPLE PARAMETER MONITORING AND READOUT SYSTEM WITH SAMPLING OF PARAMETERS OF HIGHER PRIORITY THAN THE HIGHEST PARAMETER WHICH IS OUT OF TOLERANCE

BACKGROUND OF THE INVENTION

This invention relates generally to systems for monitoring and indicating the state of each of a plurality of remotely located parameters in a complex apparatus, in particular, to monitoring and indicating the status of the vital parameters in an automotive vehicle.

Many systems are available which advise or warm the operator as to important vehicle functions. Automobiles are commonly equipped with gauges indicating vehicle speed and gasoline supply. Some vehicles are provided with gauges for oil pressure, engine temperature, and battery charging whereas other vehicles have indicators which light after a problem in one of these areas is sensed. A gauge system yields more information to the operator as a quantitative measurement is always available. However, in his preoccupation with driving the automobile, an operator may overlook or misinterpret an excessive gauge reading. While the indicator light system is calculated to catch the operator's immediate attention, the operator is denied a quantitative evaluation.

Furthermore, as automotive vehicles become increasingly more sophisticated, countless additional parameters will require surveillance. The resulting indicating systems must provide accurate and complete information to the operator without unnecessary distraction or confusion.

One approach to a multiple parameter sensing and indicating system is the U.S. Pat. No. 3,582,949 to Forst. There various parameters are prioritized and continuously sampled, the highest ranking out of limit parameter causing an indication. The drawback to Forst's system is that a continuously monitoring system requires costly duplication of circuitry.

Finally, as such systems are mass produced, it is important that the cost be kept to a minimum.

SUMMARY OF THE INVENTION

Accordingly, it is an object of the present invention to provide an improved system capable of monitoring and indicating the status of multiple remotely located parameters.

Another object of the invention is to provide an above-mentioned monitoring and indicating system whih allows prioritization of input parameters.

Another object is to provide an above-mentioned monitoring and indicating system which by means of a unique variable length ring counter, samples parameters sequentially and which automatically continues to sequentially sample all parameters of higher priority than the highest parameter which is out of tolerance.

Another object of the invention is to provide an above-mentioned monitoring and indicating system which has both warning indicator readout and quantitative readout.

A further object of the invention is to provide a monitoring and indicating system as above-mentioned which is simple yet complete and accurate to use, and which is relatively inexpensive to produce.

Briefly, according to the invention, an adjustable length ring counter is comprised of a first circuit which has a pair of inputs and a plurality of ordered outputs, such as a standard shift register. The first input receives successive signals from a sequencer, such as an oscillator, which causes successive ordered outputs to activate. A signal at the second input causes the first ordered output to activate on a subsequent signal at the first input regardless of the prior state of the ordered outputs. The signal to the second input may either be in response to a status condition of the ordered outputs, such as activation of the final one of the ordered outputs, or an externally generated program signal.

A feature of the adjustable length ring counter is that with its ordered outputs coupled to electronic switches it comprises a multiplexing scheme suitable for use in a multiple parameter sensing and indicating system.

Sensors which produce signals representative of the status of various parameters are located at each parameter site. The multiplexing scheme periodically transmits each sensor signal level to the first input of a comparator. Connected to the second input of the comparator is a programmable voltage supply which has at its output a voltage representative of the reference to which a particular parameter is to be compared. The comparator becomes activated should the sensed parameter signal level exceed its programmed reference level. An activated comparator output is used to light an indicator which corresponds to the parameter being sensed. A disclosed modification causes the comparator output to activate logic means which connects the sensed parameter signal level to a quantitative readout device, such as a meter. Then, not only would an indicator light showing the parameter out of spec activate, but also a quantitative readout of the level of the suspect parameter would be displayed. A mechanical switch may be added to the system which would allow the user to selectively readout any desired parameter whether or not the parameter exceeded its reference level.

BRIEF DESCRIPTION OF THE DRAWING

FIGS. 1 & 2 illustrate first and second preferred embodiments of the monitoring and indicating system according to the invention.

DETAILED DESCRIPTION OF THE PREFERRED EMBODIMENT OF THE INVENTION

Figure 1:
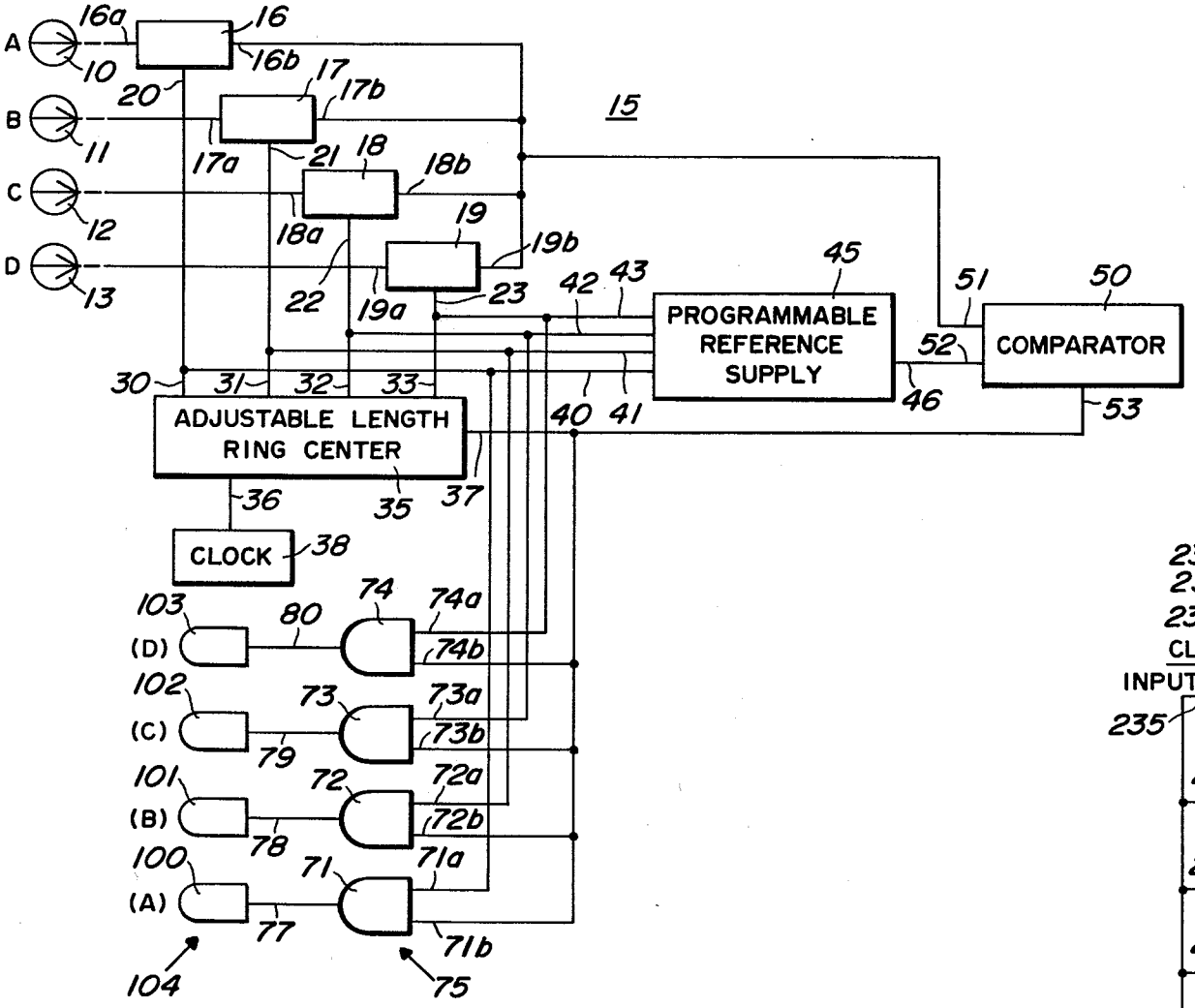

Referring to FIG. 1 four prioritized parameters to be monitored are represented by A, B, C and D. Priority oder is assumed to be alphabetical. Each parameter is sensed by a corresponding sensor 10–13. The sensor is basically a transducer which produces an output electrical signal representative of the status of the sensed parameter. Such sensors are well known in the art. Each sensor 10–13 is connected to a corresponding first pole **16*a*–19*a* of one of the electronic switches 16–19 in an electronic switch ordered array 15. Each switch in the array has a first pole 16*a*–19*a*, a second pole 16*b*–19*b*, and a control terminal 20–23. The first pole 16*a*–19*a* of a switch 16–19 is normally isolated from the second pole 16*b*–19*b*. However, when the control terminal 20–23** of a switch is activated the two poles interconnect. Such analog type electronic switches are well known in the art. Common in this application are field effect transistors, wherein the drain and source terminals of the FET represent the first and second pole and the gate terminal of the FET represents the control terminal. Countless other electronic type switches are available.

Each control terminal 20–23 of each electronic switch 16–19 connects to a corresponding one of the ordered outputs 33–33 of an adjustable length ring counter 5. Besides having ordered outputs 30–33, the adjustable length ring counter 35 has a sequence or clock input terminal 36 and a program input terminal 37. In operation, initially, the first ordered output 30 will be the only activated output of the adjustable length ring counter 35. Upon receiving a subsequent clock pulse at the clock input 36, the ring counter will cause the second ordered output 31 to become activated, the first ordered output 30 thereby deactivating. Successive clock input signals will similarly cause the third ordered output 32, and then the fourth ordered output 33 to become activated. A clock pulse at the clock input 36 subsequent to the final ordered output 33 being activated will cause the ring counter 35 to reset thus causing the initial ordered output 30 to again be the only activated output. An important feature of the ring counter in the instant application is that its length is adjustable or programmable. From the above discussion it is seen that the output from the counter 35 sequences through four ordered outputs 30–33. However, a program pulse received at the programmed input 37 to the counter 35 can cause the length of the counter 35 to decrease. A program pulse at the program input 37 causes the counter to bump back to the first ordered output 30 on a subsequent clock pulse. For example, assume the second ordered output 31 is activated. If at this time a program pulse is received at the program input 37, a subsequent clock pulse received at the clock input 36 to the counter 35 will cause the counter 35 to recycle, and activate the first ordered output 30 rather than the third ordered output 32. In similar fashion, the ring counter may be programmed to have any of from one to four ordered outputs functioning during a sequence period. The clock or sequence means 38 is shown connected to the clock input 36 of the adjustable length ring counter. The sole function of the clock 38 is to provide a series of pulses at a known rate suitable for sequencing the ring counter 35. A likely choice for the clock circuitry would be an astable multivibrator.

From the foregoing discussion it is apparent that the ordered outputs 30–33 of the adjustable length ring counter 35 can be used to prioritize the multiplexed sequence of the electronic switches 16–19. That is, the parameter of highest priority, in this case A, should connect to the first pole **16*a* of the switch 16 whose control terminal 20 is activated by the first ordered output 30 of the adjustable length ring counter. Similarly, the second highest priority parameter, B, should have its sensor output connected to the first pole 17*a* of the switch 17 whose control terminal 21 connects to the second ordered output 31** of the ring counter, connections to the third and fourth priority parameters are similarly made.

Each ordered output 30–33 of the adjustable length ring counter 35 also connects to a corresponding one of the command inputs 40–43 of a programmable reference supply 45. The programmable reference supply 45 has a controlled output with a value predeterminedly fixed and dependent upon the state of the command input terminals 40–43. Such programmable supplies are well known in the art. The purpose of the supply 45 is to produce a reference signal which will be compared to the sensor signals from parameters being monitored. Should the parameter sensor signal exceed the reference signal produced by the programmable reference supply 45 an indication of the sensed parameter is in order. The reference supply 45 is necessary as the relative signal magnitudes from the sensors 10–13 will generally not be of uniform level, and the reference to which they are to be compared will generally vary.

The controlled output terminal 46 of the programmable reference supply 45 connects to the second input 52 of a comparator 50. The first input 51 of the comparator 50 connects to each second pole **16*b*–19*b* of the electronic switches 16–19. The comparator 50 has a controlled output terminal 53 which becomes activated when the signal at its first input 51 exceeds the level at its second input 52. The output terminal 53 of the comparator 50** is otherwise inactivated.

The output terminal 53 of the comparator 50 connects to the program input 37 of the adjustable length ring counter 35. The comparator controlled output terminal 53 also connects to each one of the second input **71*b*–74*b* of an ordered array 76 of two input AND gates 71–74. The first input of each ordered AND gate 71–74 connects to a corresponding one of the ordered output 30–33 of the adjustable length ring counter 35. Thus the first input 71*a* of the first AND gate 71 connects to the first ordered output 30 of the ring counter 35, the first input 72*a* of the second AND gate 72 connects to the second ordered output 31 of the ring counter 35 and so forth. Each AND gate 71–74 produces an activated state at its output 77–80 when each of its inputs 71*a*–74*a*, 71*b*–74*b*, is activated. Each AND gate output 77–80 connects to a corresponding indicator 100–103 in the indicator matrix 104. An indicator 100–103 is activated when the output 77–80 of its corresponding AND gate 71-74** is activated.

CIRCUIT OPERATION

Initially the first ordered output 30 of the ring counter 35 is activated thereby allowing the signal from the first sensor 10 to pass from the first switch 16 first pole **16*a* to the second pole 16*b*. The signal is then passed to the first input of the comparator 50. As the command input 40 of the programmable reference supply 45 is also connected to the first ordered output 30 of the ring counter 35, the programmable supply 45 will cause its controlled output terminal 46 to assume a predetermined reference level. This reference level is applied to the second input 52 of the comparator 50. If the parameter sense signal which is applied to the first input 51 of the comparator 50 exceeds the reference signal which is applied to the second input 52 of the comparator 50 the comparator will produce an activated output at its output terminal 53. Otherwise the comparator output 53** will remain inactivated.

Assuming that the signal from the first parameter sensor 10 is less than its reference signal a subsequent pulse from the clock 38 to the clock input 36 of the adjustable length ring counter 35 will cause the ring counter's second ordered output 31 to assume an activated state. The activated state will be applied to the control terminal 21 of the second electronic switch 17 allowing the signal from the second sensor 11 to pass to the first input 51 of the comparator 50. Simultaneously, a different predetermined reference voltage will appear at the output 46 of the programmable reference supply 45 since now the reference supply's second controlled input 41 is activated. Should the signal from the second sense parameter, B, be less than its reference signal the system will sequence with the next clock pulse and monitor the third highest priority parameter, C, and so forth to the fourth highest priority parameter, D. Assume, however, that the third highest priority parameter, C, has a sensor signal which exceeds its programmed reference. The comparator output 53 will assume an activated state, this activated state being applied both to the program input 37 of the adjustable length ring counter 35 and to each second input **71*b*–74*b* of the array 75 of AND gates 71–74. At this point, the third 73 of the ordered AND gates 71–74 will have both inputs activated, as its first input 73*a* connects to the third ordered output 32 of the ring counter 35 which is currently activated. Thus, the output 79 of the third ordered AND gate 73 is activated, thereby activating its associated indicator marked C 102,** notifying the operator that a fault in parameter C has been detected.

Since the program input 37 of the adjustable length ring counter 35 has been activated upon reading the C parameter, the ring counter will, on a successive clock pulse received at the clock input 36 bump back to activate the first ordered output 30 rather than the fourth ordered output 33. Thus, only parameters having a priority equal or greater to the C parameter will be sequentially monitored until the signal from the C sensor no longer exceeds its programmed reference signal. In a similar fashion, no matter which of the four sense parameters exceeds its corresponding reference, the system will read only that parameter and all parameters of higher priority, until the sensor level returns to a below reference state.

FIG. 2 illustrates a further refinement of the basic monitor and indicate system as was described with reference to FIG. 1. The structure as shown in FIG. 2 is identical to the structure of FIG. 1 except that the following additions have been made: each one of the ordered outputs 30–33 of the adjustable length ring counter 35 is connected to a corresponding one of the fixed contacts 111–114 of a mechanical rotary switch 110. The moving contact 115 of the rotary switch 110 makes contact to a sequential one of the fixed contacts 111–114. The moving contact 115 of the rotary switch 110 connects to the second input 121 of an added OR gate 120. The OR gate's first input 122 connects to the comparator output 53. The output 123 of the OR gate 120 becomes activated when either of its inputs 121 or 122 is activated. The output 123 of the OR gate 120 connects to the logic control terminal 131 of an added logic controlled switch 130. The logic controlled switch 130 also has an input terminal 132 and an output terminal 133. The input terminal 132 and the output terminal 133 of the controlled switch 130 are normally isolated from each other. However, when the logic controlled input terminal 131 becomes activated, the first terminal 132 couples to the second terminal 133. As is discussed above with reference to the electronic switches 16-19 a field effect transistor or similar available analog switching means may be used for switch 130. The input terminal 132 of the switch 130 connects to the first input 51 of the comparator 50; the second terminal 133 of the switch 130 connects to a quantitative readout 140. The readout 140 may be an analog meter or digital volt meter which produces an indication of the relative magnitude of input signals thereto.

With the additions as noted above, when a sense parameter exceeds its reference level the comparator activates the OR gate first input 122, which in turn activates the logic control terminal 131 of the logic controlled switch 130 thereby allowing the sensed parameter sensor signal to conduct through the logic control switch 130 and to the readout 140 whereat a quantitative reading of the sensed parameter is displayed.

Should the operator desire a quantitative readout of a particular parameter, whether or not that parameter exceeded its reference, he would merely adjust the movable contact 115 of the mechanical rotary switch 110 to a setting which would cause the moving contact 115 to make contact to the stationary contact 111–114 which is connected to the ordered output 30–33 of the ring counter 35 which controls the switch 16–19 that is connected to the appropriate parameter sensor 10–13. For example, should the operator desire a readout of parameter C, regardless of whether or not this parameter exceeds its reference, the movable contact 115 would be positioned to make contact to the stationary contact 112. When the system sequenced to the switch 18 which is connected to the sensor of parameter C, an activated state would necessarily appear at ordered output 32 which would be transmitted from the first stationary contact 112 of the switch 110 to its movable contact 115 and therethrough to the OR gate 120 which would in turn activate the logic control terminal 131 of logic control switch 130 thereby routing the signal from the sensor to parameter C through switch 130 and to the readout 140 thereby displaying a quantitative readout of parameter C.

Should it be desired to keep the automatic readout feature of the system in FIG. 2 but to delete the manual readout feature a simple modification may be made. The comparator output 53 could connect directly to the logic control terminal 131 of the logic control switch 130, thus obviating the need for OR gate 120.

Figure 3:
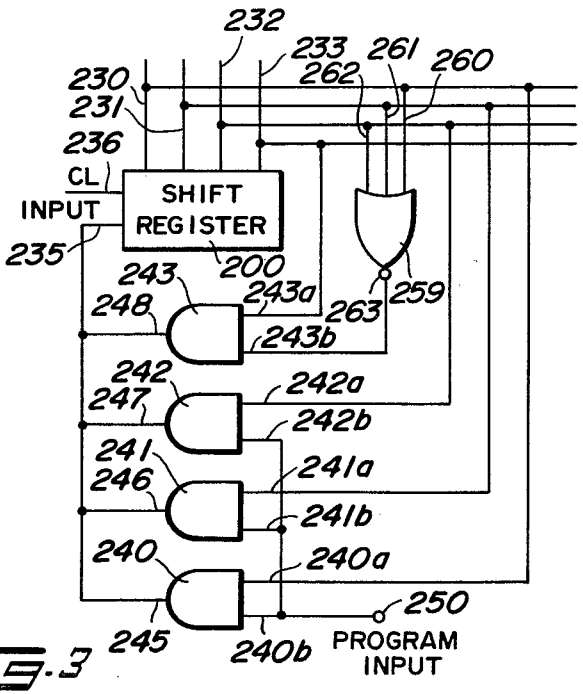
FIG. 3 illustrates the preferred construction of the inventive adjustable length ring counter employed in the system of FIG. 1 and FIG. 2.
Figure 7:
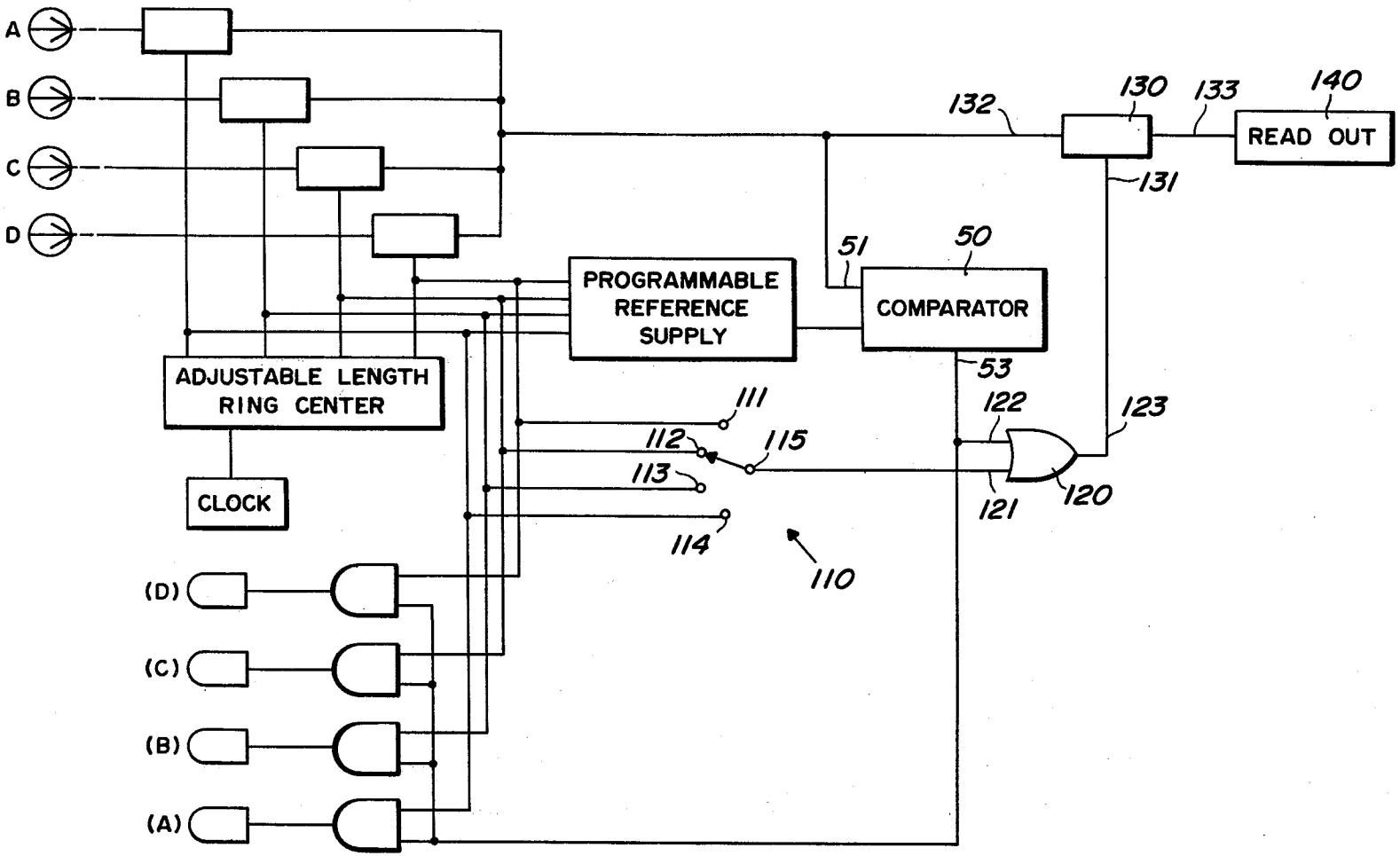

FIG. 3 illustrates a preferred embodiment of the previously mentioned adjustable length ring counter which is discussed with reference to FIG. 1. The heart of the adjustable length ring counter is a standard shift register 200 which has ordered outputs 230–233, a reset input 235 and a clock input 236. Initially the first ordered output 230 of the shift register will assume an activated state. A subsequent pulse at the clock input 236 will sequence the register 200 to activate the second ordered output 231, the first ordered output 230 returning to an inactivated state. Regardless of the state of the ordered outputs 230-233 if a signal appears at the reset input 235 a subsequent clock signal at the clock input 236 causes the shift register to bump back and activate its first ordered output 230.

The first input **240*a*–243*a* of each AND gate 240–243 in an ordered AND gate array 239 connects to a corresponding one of the shift register 200 ordered outputs 230–233. Thus, the first input 240*a* of the first AND gate 240 connects to the first ordered output 230, and so on for the remaining AND gates. Each of the AND gate second inputs 240*b*–242*b* except for the second input 243*b* of the final gate 243 connects to a program input terminal 250.**

The second input **243*b* of the final AND gate 243 connects to the output 263 of a NOR gate 259. The NOR gate has three inputs 260–262 and an output 263. Each of the three inputs 260–262 connects to a corresponding one of the first three ordered outputs 230–232 of the shift register 200.**

The clock input terminal 236 of the shift register 200 constitutes the clock input of the adjustable ring counter. Similarly, the ordered outputs 230-233 of the shift register constitute the ordered outputs of the ring counter.

Initially, the first ordered output 230 of the shift register 200 will be activated. Subsequent clock pulses at the clock input 236 will cause a succeeding one of the ordered outputs 231–233 to be activated. When the final ordered output 233 is activated, none of the inputs to the NOR gate 259 is activated, therefore the output 263 of the NOR gate is activated. At this point, the final ordered AND gate 243 has activated inputs at both 243*a* and 243*b* which cause it to produce an activated output at 240*a*. This activated output creates a reset signal at the reset input 235 of the shift register 200 such that a subsequent clock pulse received at the clock input 236 will cause the shift register 200 to bump back and activate its first ordered output 230.

However, in the course of a sequence should the program input terminal 250 be activated, as by an externally generated program signal, a reset pulse will be generated which, on receiving a subsequent clock pulse at the clock input 236, will cause the shift register 200 to bump back and activate its first ordered output 230. For example, if the shift register 200 is at a point in its sequence wherein the third ordered output 232 is activated and a program input signal is applied to the program input terminal 250, then both inputs 242*a* and 242*b* of the third ordered AND gate 242 are activated causing the output 247 of the third ordered AND gate 242 to generate a reset pulse which is applied to the reset input 235 of shift register 200 causing the shift register, upon receiving a subsequent clock pulse at its clock input at 236, to bump back and activate the first ordered output 230 rather than the fourth ordered output 233. Regardless of the output state of the ordered outputs 230–233, a signal at the program input terminal 250 will cause the shift register to bump back to activate its first ordered output on a subsequent clock pulse. In this manner, the length of the ring counter is programmable.

While the invention has been described in terms of preferred embodiments thereof, it should be clear that many variations could be made thereto which would not depart from the spirit and scope of the invention.

I claim:

1. An adjustable length ring counter having a clock input, a program input, and a plurality of ordered outputs comprising:

a shift register having a plurality of ordered outputs, a clock input, and a reset input, a sequential one of the ordered outputs assuming an activated state in response to a succeeding clock input signal, the initial ordered output being activated state in response to a reset input signal, by the next clock input signal following receipt of a reset input signal, an array of logic gates, each gate having a pair of inputs and an output, the output assuming an activated state corresponding to both of its inputs assuming an activated state, the logic output otherwise inactivated, a reset logic gate having a plurality of inputs and an output, the output of the reset gate assuming an activated state corresponding to each of its inputs assuming a nonactivated state, the output otherwise assuming a nonactivated state, each shift register ordered output connected to a corresponding one of the ring counter ordered outputs, each gate first input connected to a corresponding one of the ring counter ordered outputs, the outputs of all gates connected to the shift register reset input, the second input of all other than the final gate in the array connected to a program terminal, each reset logic gate input connected to one of the counter ordered outputs other than the final ordered output which is coupled to the first input of the final logic gate in the array, the output of the reset gate connected to the second input of the final logic gate in the array, whereby with the program input inactivated, successive clock input signals cause a successive one of the counter outputs to assume an activated state until the final ordered output state whereby a subsequent clock input signal causes the initial ordered output to assume an activated state, whereas with the program input activated a subsequent clock input signal causes the initial ordered output to assume an activated state.

2. A system for monitoring and indicating a plurality of prioritized parameters comprising:

a plurality of sensors, at least one sensor located at each parameter site, each sensor producing an electrical output proportional to the magnitude of the sensed parameter, a multiplexing means sequentially sampling and transferring the sensor outputs in prioritized order, and programmable to return to the highest priority sensor in response to a program signal, a programmed reference means sensing the status of the multiplexing means and providing an output of variable magnitude predeterminedly fixed and dependent in response thereto, means for comparing the transferred sensor output to the programmed reference output including means for generating and coupling a program signal to the multiplexing means in response to a conditional relationship between the compared signals, a means for indicating sensor status including means for sensing multiplexer status and comparator status, activating the indicating means in response thereto, whereby a parameter which does not meet the condition dictated by its reference is indicated, the multiplexing means thereafter sensing only the out of condition parameter and all higher priority parameters.

3. The monitoring and indicating system of claim 2 wherein the multiplexing means includes an adjustable length ring counter.

4. The monitoring and indicating system of claim 3 wherein the adjustable length ring counter comprises:

a first circuit means having a first input, a second input, and a plurality of ordered outputs, a sequential one of the outputs activated in response to succeeding signals at the first input, the initial ordered output activated by the next succeeding signal at the first input following receipt of a signal at the second input, a sequencing means coupled to the first input for providing the signal thereat, a second circuit means coupled to the second input and producing a signal thereat in response to a predetermined ordered output status condition or to an externally generated program signal.

5. The monitoring and indicating system of claim 2 wherein the multiplexing means includes an array having a plurality or ordered first circuit means, each means having an input, an output and a control terminal, the input of each one of the means coupled to a particular one of the sensor outputs, the control terminal connecting the input to the output upon receiving a command signal thereto, all outputs connected in common.

6. The monitoring and indicating system of claim 5 wherein the first circuit means are comprised of electronic switches.

7. A system for monitoring and indicating a plurality of prioritized parameters (in a vehicle) comprising:

a plurality of sensors, at least one sensor located at each of the parameter sites, each sensor producing an electrical output proportional to the magnitude of the sensed parameter, an array having a plurality of ordered first circuit means, each means having an input, an output and a control terminal, the input of each one of the means coupled to a particular one of the sensor outputs, the control terminal connecting the input to the output upon receiving a command signal thereto, all outputs connected in common, a second circuit means having a plurality of ordered outputs, a sequencer input, and a program input, each ordered output coupled to a corresponding one of the first circuit means control terminals, a successive one of the ordered outputs assuming an activated state in response to each sequence signal applied to the sequencer input, the first ordered output assuming an activated state corresponding to a reset signal applied to the program input, a sequence signal generating means coupled to the sequencer input, a programmed reference supply means having a plurality of ordered command input terminals, and a controlled output terminal, each ordered command input terminal coupled to a corresponding one of the second circuit means ordered outputs, the controlled output terminal assuming a value predeterminedly fixed and dependent upon the state of the command input terminals, a comparator means having a first input, a second input, and a logic output, the first input coupled to the first circuit means outputs, the second input coupled to the controlled output terminal, the logic output assuming a first state in response to a first relationship between the two inputs, the logic output otherwise assuming a second state, an ordered array of gate means, each gate means having a pair of inputs, and an output, one of the inputs of each gate means coupled to a corresponding one of the first circuit means ordered outputs, the second input of each gate means coupled to the comparator logic output, each gate means output assuming an activated state when each of its inputs assume activated states, the gate means output otherwise assuming an inactivated state, an ordered array of indicators, each indicator connected to a corresponding one of the gate means outputs, the indicator producing an output upon activation.

8. The system of claim 7 wherein the first circuit means is comprised of electronic switches.

9. The system of claim 7 wherein the second circuit means is comprised of an adjustable length ring counter.

10. The system of claim 9 wherein the adjustable length ring counter comprises:

a first circuit means having a first input, a second input, and a plurality of ordered outputs, a sequential one of the outputs activated in response to succeeding signals at the first input, the initial ordered output activated by the next succeeding signal at the first input following receipt of a signal at the second input, a sequencing means coupled to the first input for providing the signal thereat, a second circuit means coupled to the second input and producing a signal thereat in response to a predetermined ordered output status condition or to an externally generated program signal.

11. The monitoring and indicating system of claim 9 wherein the adjustable length ring counter comprises a shift register, a plurality of ordered outputs, a clock input corresponding to the first input, a reset input corresponding to the second input, sequential ones of the ordered outputs assuming an activated state in response to succeeding clock input signals, the initial ordered output assuming an activated state on the next clock signal following receipt of a reset input signal, an array of logic gates, each gate having a pair of inputs and an output, the output assuming an activated state corresponding to both of its inputs assuming an activated state, the logic output otherwise inactivated, each gate first input connected to a corresponding one of the shift register ordered outputs, the outputs of all gates connected to the shift register reset input, a program terminal coupled to the second input of each gate other than the final gate in the array, a reset logic gate having a plurality of inputs and an output, the output of the reset gate assuming an activated state corresponding to each of its inputs assuming an inactivated state, the output otherwise assuming a nonactivated state, each reset gate input connected to one of the counter ordered outputs other than the final ordered output coupled to the first input of the final logic gate in the array, the output of the reset gate connected to the second input of the final logic gate in the array.

12. The monitoring and indicating system of claim 11 further comprising:

a logic controlled switch having a first terminal, a second terminal and a logic controlled terminal, the first terminal coupled to the comparator first input, the logic controlled terminal coupled to the comparator logic output, the first logic controlled switch terminal connected to the second logic controlled switch terminal corresponding to a predetermined logic signal applied to the logic controlled terminal, the first and second terminals of the logic controlled switch otherwise disconnected.

a readout means coupled to the second terminal of the logic controlled switch, the readout means indicating the magnitude of the signal coupled thereto.

13. The monitoring and indicating system of claim 12 further comprising a logic gate having a pair of inputs and an output, the gate inserted in series in the coupling between the comparator logic output and the logic controlled switch logic controlled terminal, the first input of the gate connected to the comparator logic output, the gate output connected to the logic controlled terminal, the logic gate output assuming an activated state if either input assumes an activated state, the logic output otherwise assuming a nonactivated state.

14. The monitoring and indicating system of claim 13 further comprising a multipole position switch, the switch having an ordered sequence of first contacts and a second contact, the second contact sequentially connecting to one of the first contacts, each first contact coupled to a corresponding one of the counter ordered outputs, the second contact connected to the second input of the logic gate.

15. A system for monitoring and indicating a plurality of prioritized parameters (in a vehicle) comprising:

a plurality of sensors, at least one sensor located at each of the parameter sights, each sensor producing an electrical output proportional to the magnitude of the sensed parameter, an electronic switch array having a plurality of ordered switches, each switch having a first pole, a second pole and a control terminal, the first pole of each of the switches coupled to a particular one of the sensor outputs, the control terminal connecting the first pole to the second pole upon receiving a command signal thereto, all second poles in common, an adjustable length ring counter having a plurality of ordered outputs, a sequencer input, and a program input, each ordered output coupled to a corresponding one of the switch control terminals, a successive one of the ordered outputs assuming an activated state in response to each sequence signal applied to the sequencer input, the first ordered output assuming an activated state corresponding to a reset signal applied to the program input, a sequence signal generating means coupled to the sequencer input, a programmed reference supply means having a plurality of ordered command input terminals, and a controlled output terminal, each ordered command input terminal coupled to a corresponding one of the ring counter ordered outputs, the controlled output terminal assuming a value predeterminedly fixed and dependent upon the state of the command input terminals, a comparator means having a first input, a second input, and a logic output, the first input coupled to the second poles, the second input coupled to the controlled output terminal, the logic output assuming a first state if the signal at its first input is more positive than the signal at its second input, the logic output otherwise assuming a second state, a logic controlled switch having a first terminal, a second terminal and a logic controlled terminal, the first terminal coupled to the comparator first input, the logic controlled terminal coupled to the comparator logic output, the first logic controlled switch terminal connected to the second logic controlled switch terminal corresponding to a predetermined logic signal applied to the logic controlled terminal, the first and second terminals of the logic controlled switch otherwise disconnected, a readout means coupled to the second terminal of the logic controlled switch, the readout means indicating the magnitude of the signal coupled thereto, a logic gate having a pair of inputs and an output, the gate inserted in series in the coupling between the comparator logic output and the logic controlled switch logic controlled terminal, the first input of the gate connected to the logic output, the gate output connected to the logic controlled terminal, the logic gate output assuming an activated state if either input assumes an activated state, the logic output otherwise assuming a nonactivated state.

16. The monitoring and indicating system of claim 15 further comprising an ordered array of logic gates, each gate having a pair of inputs, and an output, one of the inputs of each gate coupled to a corresponding one of the ring counter ordered outputs, the second input of each gate coupled to the comparator logic output, each logic gate output assuming an activated state when each of its inputs assume activated states, the logic gate output otherwise assuming an activated state, an ordered array of indicators, each indicator connected to a corresponding one of the logic gate outputs, the indicator producing an output only upon activation.

17. A monitoring and indicating system comprising:

sensing means for continuously monitoring a plurality of prioritized engine parameters and providing for each parameter a separate electrical output signal representative of the status thereof, programmable reference supply means for providing a reference output voltage having a predetermined fixed value corresponding to each of the parameters, circuit means having one input terminal adapted for coupling to the sensing means and the other input terminal adapted for coupling to the programmable reference supply means for generating an alarm signal when the output signal level from the sensing means is out of tolerance with respect to the signal level of the reference supply means, variable length ring counter means for repeatedly sequentially coupling the sensing means monitoring a selected one of the parameters to the one terminal of the circuit means while simultaneously repeatedly sequentially activating the programmable reference supply means to cause the corresponding parameter reference voltage to be coupled to the other terminal of the circuit means, an output signal appearing at the circuit means being coupled to the variable length ring counter for shortening the sequencing cycle thereof to sequence through only the parameters having equal or greater priority than the parameter causing the output signal to appear at the circuit means, and means for indicating the alarm signal.

* * * * *